United States Patent [19]

Wacks et al.

[11] 4,199,615

[45] Apr. 22, 1980

[54] DRY-PROCESS IMAGING FILM AND METHOD

[75] Inventors: Harvey H. Wacks, Southfield; Donald J. Sarrach, Novi, both of Mich.

[73] Assignee: Energy Conversion Devices, Inc., Troy, Mich.

[21] Appl. No.: 770,076

[22] Filed: Feb. 18, 1977

Related U.S. Application Data

[63] Continuation of Ser. No. 507,049, Sep. 18, 1974, abandoned.

[51] Int. Cl.[2] ..... B05D 3/06; G03C 5/04; G03C 5/24

[52] U.S. Cl. ..... 427/43.1; 427/53.1; 427/56.1; 428/199; 428/208; 428/209; 428/421; 428/425.8; 428/457; 428/458; 428/538; 428/913; 250/316.1; 250/317.1; 430/494; 430/346; 430/292; 430/348; 430/496; 430/523; 430/524

[58] Field of Search ..... 96/27 R, 27 E, 48 R, 96/48 HD, 48 QP, 67, 1.5, 36.2, 44; 427/56, 43, 53; 250/316, 317; 428/199, 208, 209, 421, 425, 458, 457, 538, 913

[56] References Cited

U.S. PATENT DOCUMENTS

| | | | |
|---|---|---|---|
| 2,633,423 | 3/1953 | Bower et al. | 96/67 |
| 3,392,020 | 7/1968 | Yutzy et al. | 250/317 |
| 3,451,813 | 6/1969 | Kinney et al. | 96/36.2 |
| 3,476,578 | 11/1969 | Brinckman | 250/317 |
| 3,655,421 | 4/1972 | Long | 428/208 |
| 3,856,526 | 12/1974 | Hamb et al. | 96/48 HD |
| 3,857,708 | 12/1974 | Verhille et al. | 96/1.5 |
| 3,864,132 | 2/1975 | Rasch et al. | 96/67 |
| 4,000,334 | 12/1976 | Hallman et al. | 96/48 QP |
| 4,055,432 | 10/1977 | Masuda et al. | 96/114.1 |

FOREIGN PATENT DOCUMENTS

| | | | |
|---|---|---|---|
| 1286503 | 8/1972 | United Kingdom | 96/48 R |

OTHER PUBLICATIONS

Harris, et al, Continuous Wave Laser Recording on Metallic Thin Film, Image Technology, vol. 12, No. 3, p. 31, 4/5/1970.

*Primary Examiner*—Won H. Louie, Jr.
*Attorney, Agent, or Firm*—Wallenstein, Spangenberg, Hattis & Strampel

[57] ABSTRACT

A dry-process imaging film which is sensitive to, and substantially simultaneously imaged and developed by, electromagnetic radiation above a threshold value applied thereto through an imaging mask. The film, in its preferred form, comprises a thin solid continuous, non-particulate film of a dispersion imaging material provided with a thin, flexible, protective overlayer of a polymeric resin. The film of dispersion imaging material is carried or supported on a flexible plastic substrate which may be transparent or light reflective.

6 Claims, 5 Drawing Figures

DRY-PROCESS IMAGING FILM AND METHOD

Figure 1:
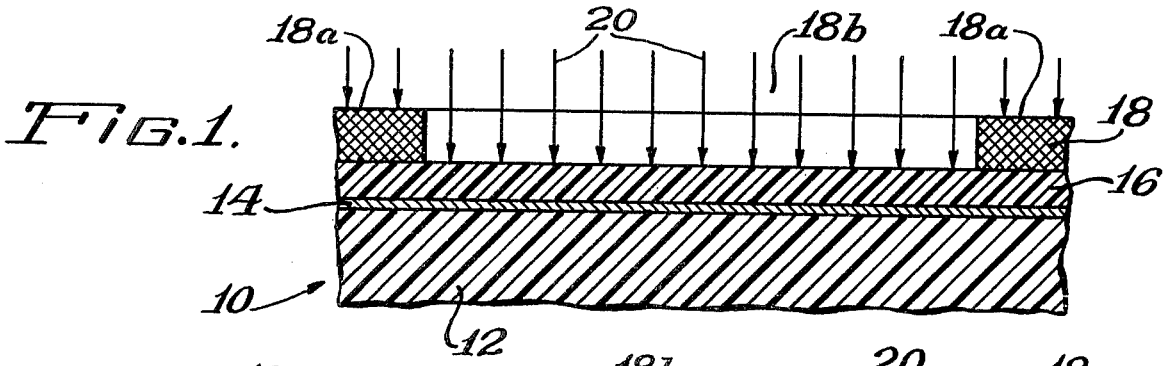
Figure 2:
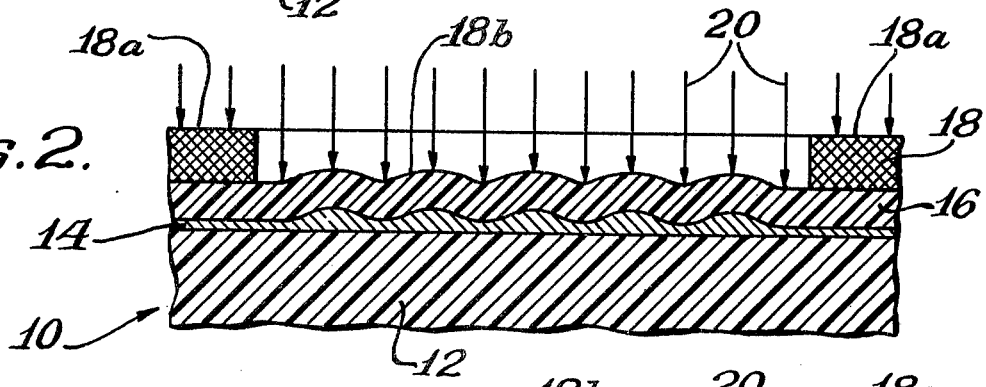
Figure 3:
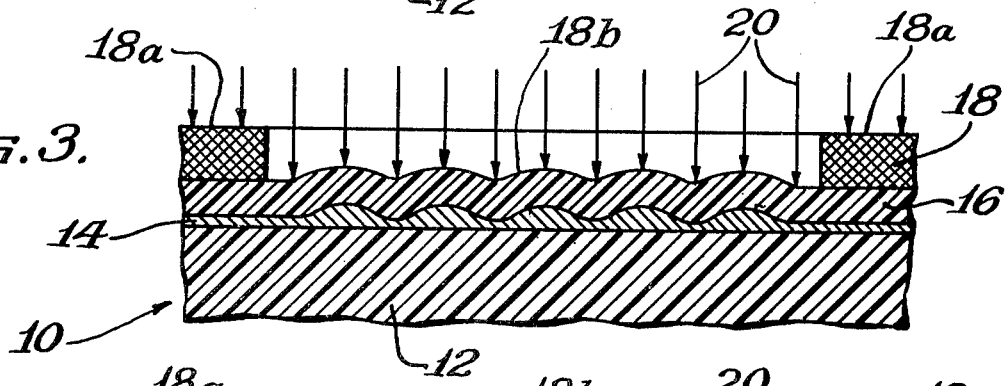
Figure 4:
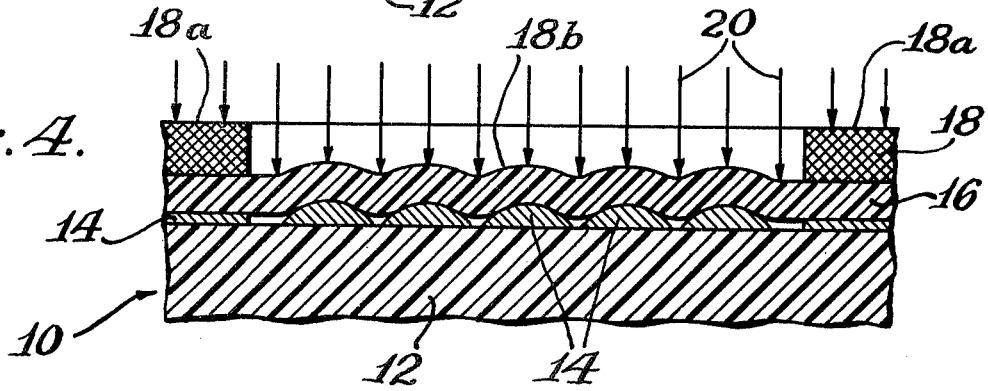

This is a continuation, of application Ser. No. 507,049, filed Sept. 18, 1974, abandoned.

The present invention relates to an improved dry-process imaging film, and to a method utilizing the film.

In copending applications Ser. No. 162,842 filed July 15, 1971, entitled "Method of Producing Images" by Hallman et al, and Ser. No. 497,944, filed Oct. 19, 1973 as a continuation-in-part of Ser. No. 162,842, and, also, entitled "Method of Producing Images", there is disclosed a dry-process method of producing images utilizing an imaging film comprising a substrate having a solid, continuous, non-particulate film of a dispersion imaging material thereon. The dispersion imaging material, upon application of energy to the film in an amount sufficient to increase the absorbed energy in the material above a certain threshold value, is capable of changing to a state in which the surface tension of the material acts to cause the continuous film where subject to said energy to change toward the formation of spaced apart separate globules to provide a stable image on the imaging film. While the imaging film employed in the method of the aforementioned copending applications is uniquely qualified as a dry-process film for producing stable images, the film requires precautionary measures to be taken, especially in the handling of the film both before and after imaging, to prevent marring of the continuous, non-particulate film of dispersion imaging material.

In accordance with the present invention, an improved dry-process imaging film is provided which has excellent resistance to abrasive forces. As a result, the imaging film can be handled and processed both manually and mechanically without the need for taking special precautions to prevent damage from abrasion to the film. The excellent abrasion-resistant qualities of the imaging film, furthermore, substantially enhance the archival properties of the imaged film. These results, surprisingly, are achieved with no concomitant impairment of the ability of the imaging film to be imaged and developed simultaneously by the application of energy thereto, and with no adverse effect on the ability of the imaged film to provide an image having sharp definition, high resolution and high contrast characteristics.

Briefly, the improved imaging film of this invention, as in the case of the imaging film utilized in the dry-process method of the aforementioned copending applications, comprises a substrate, and a thin, continuous, solid, non-particulate film of a dispersion imaging material on the substrate. The imaging film of the present invention differs from the imaging film used in the method of the aforementioned applications in that a thin, continuous flexible or pliable film, or layer, of a polymeric resin is provided on the film of dispersion imaging material. The film of polymeric resin is characterized in that it is substantially resistant to abrasive forces which, in the absence of the resin film, would abrade, damage, or mar, the film of dispersion imaging material. The resin film is further characterized in that it does not significantly impede the transmission of imaging energy to, or the absorption of imaging energy by, the dispersion imaging material. Further, in this same connection, the resin film does not interfere with image read-out, or the reproduction of images produced in the film of dispersion imaging material. The resin film also is characterized in that it is substantially non-wettable when imaged by the dispersion imaging material, and is sufficiently pliable, or flexible, to enable the continuous, non-particulate film of dispersion imaging material, where subjected to imaging energy, to readily change toward the formation of spaced apart separate globules, and to enable the globules to remain in spaced apart relation after application of energy has been discontinued, thereby to provide a stable image in the imaging film. As indicated, it is noteworthy that the resin film while significantly enhancing the resistance of the imaging film to marring, or damage, and, at the same time, increasing the archival properties of the imaged film, does not impede in any way the ability of the dispersion imaging material to be dispersed imagewise by the application of energy thereto through the resin film, and has no adverse effects whatever on the sharp definition, high resolution and high contrast characteristics of images reproduced from the imaged film.

The term "dispersion" as used herein means that a thin, solid, continuous, non-particulate film material becomes discontinuous when the internal energy of the material is increased above a critical threshold value as the result of absorption of energy. When this value is reached, areas will form in the film which are more transmissive to, or less reflective of, for instance, light, than other areas of the film, such that a detectable image consisting of a plurality of transmissive or reflective areas, and areas of lesser transmissiveness or reflectance is formed.

The dispersion imaging materials useful in the practice of the invention are characterized in that they have a melting or softening point which is low enough to permit temporary melting or at least softening of the material under the effect of an available source of imaging energy. The dispersion imaging materials are further characterized in that they have, at, or above, their melting or softening point, a viscosity which is low enough to permit the flowing together thereof into small globules, droplets or similar structures, or at least the thinning out thereof sufficiently to form selected transmissive or reflective areas. At the same time, the imaging material should preferably also have a relatively high surface tension in relation to the substrate and resin overlayer when it is in the molten or softened state to promote globule or droplet formation. In addition, the dispersion imaging material when in a molten or softened condition, should also have a low wettability for the substrate and the overlayer of polymeric resin. If the wettability of the dispersion imaging material for the substrate and polymeric resin overlayer is too great, insufficient dispersion and poor images may result. Thus, a particular dispersion imaging material may be an excellent dispersion imaging material for use in connection with one substrate-overlayer combination while being a comparatively poor one for use in connection with another substrate-overlayer combination. Therefore, the selection of a suitable dispersion imaging material for a given imaging system is an important consideration.

Still another desirable property of the dispersion imaging material is that it have a relatively low thermal conductivity. The importance of the low thermal conductivity of the dispersion imaging material resides in the fact that it results in less lateral heat conduction so that lateral bleed is minimized at the boundary between dispersed and non-dispersed areas of the continuous, non-particulate film. Images produced with low to medium thermal conductivity dispersion imaging materials are, therefore, sharper and provide higher resolution. In those instances where a particular dispersion imaging material does not have high opacity, or low reflectivity, respectively, in its deposited film state, opacity, or low reflectivity, may be enhanced or augmented by adding organic dyes, or very finely divided, or powdered pigments such as carbon black, and the like, on the surface of, or directly to, the dispersion imaging material.

Exemplary of dispersion imaging materials which satisfy the aforementioned desiderata are metals such as bismuth, antimony, aluminum, cadminum, zinc, tin, selenium, polonium, indium, and the like, and alloys and compounds thereof. Of the foregoing, bismuth is especially preferred. Also useful are the chalcogenide elements, excepting oxygen, and the glassy or crystallized compositions containing them. Specific examples of such materials are tellurium and various compositions containing tellurium, and other chalcogenides such as compositions of (parts being by atomic weight percent in each instance) 92.5 atomic parts tellurium, 2.5 atomic parts germanium, and 2.5 atomic parts silicon and 2.5 atomic parts arsenic; a composition of 95 atomic parts tellurium and 5 atomic parts silicon; a composition of 90 atomic parts tellurium, 5 atomic parts germanium, 3 atomic parts silicon and 2 atomic parts antimony; a composition of 85 atomic parts tellurium, 10 atomic parts germanium and 5 atomic parts bismuth; a composition of 85 atomic parts tellurium, 10 atomic parts germanium, 2.5 atomic parts indium and 2.5 atomic parts gallium; a composition of 85 atomic parts tellurium, 10 atomic parts silicon, 4 atomic parts bismuth and 1 atomic part thallium; a composition of 70 parts tellurium, 10 atomic parts arsenic, 10 atomic parts germanium and 10 atomic parts antimony; a composition of 60 atomic parts tellurium, 20 atomic parts germanium, 10 atomic parts selenium and 10 atomic atomic parts sulfur; a composition of 60 atomic parts tellurium, 20 atomic parts germanium and 20 atomic parts selenium; a composition of 60 atomic parts tellurium, 20 atomic parts arsenic, 10 atomic parts germanium and 10 atomic parts gallium; a composition of 81 atomic parts tellurium, 15 atomic parts germanium, 2 atomic parts sulfur and 2 atomic parts indium; a composition of 90 atomic parts selenium, 8 atomic parts germanium and 2 atomic parts thallium; a composition of 85 atomic parts selenium, 10 atomic parts germanium and 5 atomic parts copper ; a composition of 85 atomic parts selenium, 14 atomic parts tellurium and 1 atomic part bromine; a composition of 70 atomic parts selenium, 20 atomic parts germanium and 10 atomic parts bismuth; a composition of 95 atomic parts selenium and 5 atomic parts sulfur; and variations of such compositions.

By way of summary, generally speaking, those materials, which have a melting or softening point in the range from about 150° C. to about 750° C., especially desirably from 250° C. to about 450° C., a viscosity at or above the melting or softening point in the range from about $10^{-2}$ poises to about $10^{5}$ poises, a thermal conductivity of from $10^{-4}$ $$\frac{\text{cal} \cdot \text{cm}}{\text{cm}^2 \cdot \text{s} \cdot \text{deg} \cdot \text{C}} \text{ to } 10^{-1} \frac{\text{cal} \cdot \text{cm}}{\text{cm}^2 \cdot \text{s} \cdot \text{deg} \cdot \text{C}},$$

and a surface tension in the softened or molten state of from 50 to 1000 dys/cm, are excellent dispersion imaging materials. Some of the materials having a surface tension in the upper stated range may require ultrasonic vibration for operativeness. Generally, those materials having in molten form a low to medium surface tension within the stated range are preferred, though the surface tension should be high enough in relation to the substrate and the polymeric resin overlayer so that the wettability thereof by the molten or softened dispersion imaging material is relatively low to enable the preferred globules to form upon dispersion of the material by the radiant energy. Stated differently, if the surface tension of the dispersion imaging material is low, generally only a narrow selection of suitable substrates and polymeric resins is available. If on the other hand, the surface tension of the molten dispersion imaging material has higher values then, usually, a larger selection of substrates and polymeric resins is available.

It is to be noted that no single property is decisive of whether or not a given material makes a good dispersion imaging material for the purposes of this invention. It is a combination of the above stated properties which permit the selection of the most suitable dispersion imaging material for a given system and purpose including also such properties as opacity, reflection, adhesiveness to the substrate and the ease with which it can be applied thereto, in addition to such other factors as a relatively low vapor pressure at the melting or softening temperature or at the temperature reached in the dispersion step. As indicated above, bismuth most nearly meets all of these criteria. Bismuth is highly opaque, melts at a relatively low temperature, i.e., about 269° C., and can be applied easily on plastic substrates. Also, the generally low thermal conductivity of bismuth makes it possible to use low intensity radiant energy of short duration for complete dispersion in the irradiated areas, producing a minimum of thermal bleed or fuzziness, and resulting in extremely sharp images of high resolution.

The continuous, non-particulate film of dispersion imaging material may be applied on a selected substrate by any convenient means, for instance, by thermal evaporation and deposition in vacuum, by sputtering, by application in the form of a solution with subsequent evaporation of the solvent, and so forth. The thickness of the film of dispersion imaging material is somewhat variable. The generally optimum objectives of the invention are met, however, with dispersion imaging material film thicknesses ranging from about 300 to about 2500 Angstroms, usually from about 500 to about 2000 Angstroms, and preferably about 700 to about 1000 Angstroms. The optical densities of a film of the thicknesses indicated will range from about 0.7 to about 3, usually from about 1.2 to about 2. The dispersion imaging materials employed in making the imaging film of this invention are further characterized by their high gamma which is usually greater than 10. The sharp edge definition attained with the imaging film due to the high gamma of the dispersion imaging material enables the production of films having a resolution of the order of 600, or more, lines per millimeter.

The substrates having utility for the purposes of this invention can be selected from a wide group. The substrate may comprise an inorganic material such as silicate glass, a ceramic, a metal or mica. Preferred are organic substrates which, because of their flexibility, can be employed in rolls to provide continuous lengths of substrate material. Those substrates which have a thermal conductivity of below about $1.5 \times 10^{-3}$ $$\frac{\text{cal} \cdot \text{cm}}{\text{cm}^2 \cdot \text{s} \cdot \text{deg} \cdot \text{C}}$$

at room temperature are preferred.

Suitable organic substrates can be found among the polyesters as exemplified by polyethylene glycol terephthalate (Mylar). Other suitable organic substrates are polyamides, cellulose acetate, polystyrene, polyethylenes especially cross-linked polyethylenes, polypropylene, and many more. Generally all those organic materials can be beneficially used as substrates which can be brought into the form of a thin film or sheet and which show good affinity to the selected dispersion imaging material so that the latter can be applied thereto. In addition, as indicated above, a selected substrate should have as low a wettability as possible for the molten dispersion imaging material so that the dispersion imaging material can be dispersed into the preferred small globules or similarly shaped structures upon exposure to radiant energy. Especially satisfactory are such materials as Mylar film and cellulose acetate film, both of which produce transparencies. Desirable also are low porosity, heavily filled papers of various grades, or other opaque cellulosic products for producing images for reflection viewing. The thickness of the preferred organic substrates can range form about 2 to 15 mils, with a thickness of about 7 mils being especially desirable when the film is to used in the production of microfilm or microfiche.

If it is desired to use a certain substrate with a given dispersion imaging material, but, because of its wettability properties, it is unsatisfactory, it is possible to provide an intermediate layer on the substrate which reduces the wettability by a given dispersion imaging material so that the dispersion imaging material readily disperses upon application of radiant energy at the required threshold level. This may be achieved, for instance, by coating the substrate, prior to the deposition of the dispersion imaging material, with a material which has a low wettability for the dispersion imaging material. Exemplary of materials useful for this purpose are aluminum oxide, silicon oxide, and the like. The thickness of such a film can range from about 10 to about 500 Angstroms, usually about 150 to about 300 Angstroms. The same kind of treatment of the surface of the substrate may also enable the dispersion imaging material to form smaller units in the dispersed phase where the unit size would otherwise not be acceptable. By this expedient it is possible to greatly increase the choice of suitable substrates for a given dispersion imaging material.

The polymeric resins utilized as the protective overlayer for the dispersion imaging material can be selected from a wide group of materials. Included in this group are plastic film forming materials such as polyurethanes; vinyl polymers and copolymers exemplified by polyvinylidene chloride, polyvinyl acetate, polyvinyl butyral; copolymers of vinylidene chloride and vinyl acetate; vinylidene chloride and acrylonitrile; and vinyl chloride and vinyl acetate; polycarbonates; polyamides; polyesters; FEP-fluorocarbons such as the copolymer of tetrafluoroethylene and hexafluoropropylene; cellulose triacetate; copolymers of styrene and acrylonitrile acrylonitrile-butadiene-styrene (ABS) copolymers; and the like. Especially suitable is the polyurethane product sold under the designation "ESTANE 5715" (B. F. Goodrich Chemical Co.). Films formed of this material combine high strength and toughness at very small thicknesses. The films, in addition, are characterized by their outstanding resistance to abrasion and atmospheric contaminants, and their dimensional stability. Also highly suitable as an overlayer for the dispersion imaging film is the copolymer of vinylidene chloride and vinyl acetate (SARAN). Films formed of this material have good dimensional stability, excellent resistance to abrasion and chemical attack, and retain their flexibility over a wide temperature range.

The polymeric resin overlayer advantageously is applied to the film of dispersion imaging material in the form of a solvent solution. Thus, for example, the polyurethane sold under the designation "ESTANE 5715" can be applied as a solution comprising 20% solids in methylethyl ketone. Application may be accomplished by any means known in the art, including spraying, roller coating, curtain coating, brushing, or the like. The thickness of the overlayer of polymeric resin can range from about 0.1 micron to about 5, or more, microns. Most desirably, the thickness of the resin film layer will range from about 0.5 micron to about 3 microns.

The imaging film of this invention is readily adaptable to machine processing. In order to prevent or substantially reduce, blocking and/or adhesion of the resin overlayer to machine parts such as rollers, a thin film or layer of an anti-blocking or anti-sticking agent advantageously is applied to the outer surface of the resin layer. Various agents can be used for this purpose, specific examples of which are octadecyl acrylate-acrylic acid copolymers, vinyl stearate-maleic anhydride copolymers, stearato chromic chloride, silicone oils, and the like. The copolymer of maleic anhydride and n-octodecyl vinyl ether sold under the designation "GANTREZ AN 8194" (GAF) is an excellent product for this purpose.

In the accompanying drawing, an embodiment of the imaging film of this invention is shown being selectively exposed to radiant energy to provide an imaged product. As illustrated, the embodiment, designated generally by the numeral 10, comprises a substrate 12, such as Mylar, on which is disposed a thin, continuous, non-particulate layer or film 14 of an opaque dispersion imaging material, such as bismuth. On the film 14 of dispersion imaging material there is a transparent, protective overlayer of film 16 of a polymeric resin such as polyurethane. An imaging mask 18, such as an imaged, dry silver mask, comprising opaque portions or areas **18*a*—18*a* and a transparent portion or area 18*b*, is positioned on the overlayer 16. Arrows 20** represent electromagnetic energy emitted by a suitable source such as a Xenon Flash Gun.

As shown in FIGS. 1–4, when a short pulse of electromagnetic energy, as represented by the arrows 20, is applied above a threshold value, such energy pulse is absorbed and scattered by the opaque areas **18*a*—18*a* of the mask 18 so as not effectively to reach the film 14 of dispersion imaging material of the imaging film 10 at those areas thereof underlying the areas 18*a* —18*a*. However, such short energy pulse readily passes through the transparent area 18*b* of the mask 18 and the transparent overlayer 16 to the continuous, non-particulate film 14 of dispersion imaging material where the energy pulse is absorbed. This absorption of the electromagnetic energy pulse acts to heat the film 14 to at least a softened or molten condition, whereupon the continuous film 14 at the area 26 of the film 10 is broken up and dispersed into small and widely spaced globules 24 to make the area 26 substantially transparent (see FIG. 5). This dispersion of the film 14 at the heated soft or molten area 26 is occasioned principally by the surface tension of the heated dispersion imaging material which causes the heated material to form small and widely spaced globules 24. After the globules are so formed by the short pulse of the electromagnetic energy, they quickly cool and remain in that globular condition to provide the substantially transparent condition of the area 26 as shown in FIG. 5**.

The spaced apart globules 24 have a thickness dimension which is greater than the thickness dimension of the thin continuous film 14 due to the fact that the volume of the material in the area 26 necessarily remains the same. However, this change in thickness dimension is readily accommodated by the resiliency and nature of the flexible substrate 12 and the resilient, flexible nature of the protective resin overlayer 16 of the imaging film 10. In this latter connection, as best shown in FIG. 5, the overlayer 16, under the effects of the energy pulse, tends to soften, and to thin-out at its outer surface and to partially fill the spaces between the globules 24.

Figure 5:
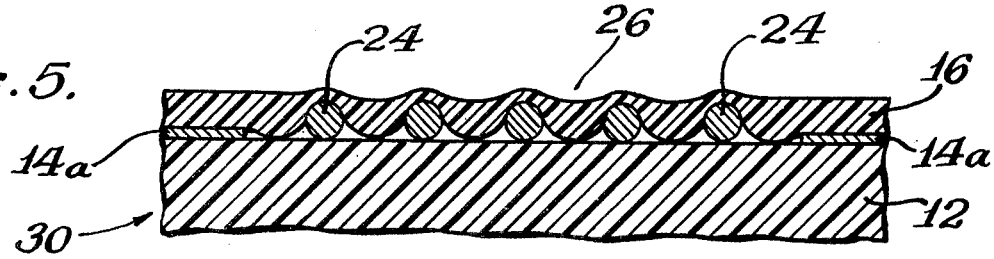

The ultimate imaged product which is capable for use for retrieving data or information imaged therein, designated by numeral 30 in FIG. 5, includes the substantially transparent substrate 12, the substantially transparent protective resin film 16, the continuous, solid, substantially opaque areas 14*a*—14*a*, and the substantially transparent area 26 containing the globules 24 formed of dispersion imaging material. The globules 24 are so extremely small in size, for example, of the order of 1 micron, or less, and are spaced apart at a distance such that the exposed area 26 is highly transparent even at considerable magnification. The imaging film 10 is a positive of the mask 18. The image produced in the film 10 is a transparency which is readable in the transmission mode.

The dispersion imaging material has been represented in the drawing as forming perfect spheres in the imaged area. Depending upon the nature and composition of the dispersion imaging material, upon the conditions under which energy is applied to the film, and the nature of the substrate and the polymeric resin overlayer, the dispersed material may take the form of flattened spheres, "lenses", blisters, droplets, irregularly shaped globules, or other forms such as flakes. To be useful, the dispersed material must be in a form such that a readily detectable difference is provided between transmission or reflection in the dispersed areas as against the non-dispersed areas which are in their original state. This difference may also be provided by thinned out areas of dispersion imaging material instead of areas which contain globules of the material as described above.

Any desired source of energy may be used provided that it produces the amount of energy required for dispersion by short pulses of energy. Especially suitable for imaging through a mask are the devices known generally as electronic flash guns which are capable of producing short flashes of, for instance, 10 microseconds, or so, to several hundred milliseconds, or more, and an energy output which is high enough to cause dispersion of the dispersion imaging material. Other sources and forms of energy such as flash bulbs, infrared lamps, particle beam generators and the like, also may be used so long as they provide the heat or other energy needed for melting, or softening, and dispersing the dispersion imaging material. A convenient source of energy of sufficient power density is the laser. By the use of a laser in combination, for example, with a dispersion imaging material such as bismuth, it is possible to use smaller, less expensive lasers for forming an image, e.g. by scanning and modulation of the laser beam. For full format flashing through a mask, however, the above mentioned flash guns or similar devices of high light and heat output are preferred, with the beam of radiant energy preferably being kept stationary in relation to the image mask and to the imaging film.

Some care must be employed in selecting the intensity and duration of application of the energy for imaging through an imaging mask. Since some of the energy also passes through the opaque areas of the imaging mask, the intensity and time of the energy application must be proportioned such that enough energy passes through the "transparent" or energy transmissive areas of the imaging mask to cause dispersion in the corresponding areas of the film of dispersion imaging material, but the amount of energy applied must be small enough, so that preferably no dispersion takes place in the areas of the film of dispersion imaging material corresponding to the "opaque" or non-transmissive areas of the imaging mask.

The images produced with the imaging film of this invention may be directly viewed, or viewed with the aid of suitable reflectance or transmission readers. The images may also be read by detection equipment using optical, electrical or other physical principles in their operation.

The invention will be further illustrated by the following examples.

EXAMPLE I

An 800 Angstroms thick film of bismuth is deposited, by sputtering, on a 5 mil thick Mylar film. A transparent layer, 1 micron thick, of a copolymer of vinylidene chloride and vinyl acetate (Saran) is formed on the bismuth film by spraying thereon a solution of the copolymer comprising 25% solids in methylethyl ketone (MEK), and drying at 80° C.

A chromium mask, containing a microrecord representation, is placed on the resin overlayer of the imaging film and the film is subjected through the mask to a ½ millisecond flash of a Honeywell 700 electronic flash unit, held at a distance of one inch from the film plane.

A positive transparency copy of the microrecord, having excellent resolution and sharp definition is obtained. The resin overlayer shows excellent resistance to abrasion during handling.

EXAMPLE II

A 1000 Angstroms thick film of bismuth is vacuum deposited on a 5 mils thick polystyrene film. A transparent layer of polyurethane, 1 micron thick, is formed on the bismuth layer by spraying a polyurethane (ESTANE 5715) solution, comprising 20% solids in MEK, on the bismuth layer, and drying at 80° C. A dry silver mask, containing a microrecord representation, is then placed onto the polyurethane overlayer, and the film is exposed through the mask to a 10 millisecond flash of a GE No. 5 clear flash bulb placed at a distance of one-half inch.

A positive transparency copy of the microrecord, having high resolution and sharp definition, is obtained.

EXAMPLE III

A 1200 Angstroms thick film of tellurium is deposited by vacuum deposition onto a 5 mil thick film of Mylar. A transparent layer of polyurethane is applied to the film of tellurium as in Example II. A thin film of an anti-stick material (Gantrez AN 8194) is then applied to the polyurethane.

A mask of a silver halide emulsion on a cellulose acetate substrate representing a microfilm master and containing letter representations is placed in close contact with the resin overlayer. The beam of a pulsed Argon laser of 100 milliwatts, Tru Model 83A, is focused on the image plane and the master is serially scanned with the pulsed laser at a 4 microsecond pulse width to produce a copy of the master on the tellurium layer.

A positive transparency copy, having high resolution and sharp definition, of the letter representations on the master is obtained.

What is claimed is:

1. An essentially instantaneous dry-process method of producing an image, comprising providing a dry-process imaging film consisting essentially of a substrate, a thin, continuous, non-particulate solid film of a dispersion imaging material on the substrate, and a thin, flexible continuous transparent film of a polymeric resin on the film of dispersion imaging material said dispersion imaging material comprising a metal or metal-like substance and being capable, upon application to the imaging film of a short pulse of high intensity radiant energy in an amount sufficient to increase the absorbed energy in the material above a certain threshold value, of changing to a substantially molten state in which the surface tension of the material acts to cause the continuous film of the dispersion imaging material where subject to said energy pulse to change to a discontinuous film comprising spaced globules and free space therebetween in the dispersion imaging material through which light can pass, said film of polymeric resin being capable, upon application to the imaging film of a short pulse of high intensity radiant energy in an amount sufficient to increase the absorbed energy of the dispersion imaging material above a certain threshold value, of softening and flowing into the free, light transmitting spaces between the spaced globules of dispersion imaging material while still providing a protective overlayer for the dispersion imaging material, applying a short pulse of high intensity radiant energy through an imaging mask having an image pattern including portions of higher transmissiveness and portions of lower transmissiveness for said energy pulse to the continuous film of dispersion imaging material through the film of polymeric resin in an amount sufficient to increase the absorbed energy in the dispersion imaging material above a certain threshold value in areas thereof underlying the film of polymeric resin corresponding to said portions of higher transmissiveness of said pattern of the imaging mask to essentially instantaneously cause the dispersion imaging material in those areas to change to a discontinuous condition comprising spaced globules and free space through which light can pass and to cause at the same time the polymeric resin to soften and to flow into the free space between the spaced globules while maintaining a protective overlayer of the polymeric resin on the dispersion imaging material, and, following the application of the short pulse of high intensity radiant energy permitting the separate globules to become fixed in spaced apart relation and the polymeric resin to harden in the free spaces between the spaced globules and over the dispersion imaging material, to provide essentially instantaneously a stable, finished image in the imaging film corresponding to said image pattern of the imaging mask.

2. A method according to claim 1 wherein the metal or metal-like substance comprising the dispersion imaging material has a melting point of about 150° C. to about 750° C.

3. A method according to claim 1 wherein the thickness of the film of dispersion imaging material on the substrate is about 300 to about 2500 Angstroms.

4. A method according to claim 1 wherein the thickness of the film of polymeric resin is about 0.1 micron to about 5 microns.

5. A method according to claim 1 wherein the polymeric resin is selected from the group consisting of polyurethane and a copolymer of vinylidene chloride and vinyl acetate.

6. A method according to claim 1 wherein the dispersion imaging material is metal selected from the group consisting of bismuth, antimony, aluminum, cadmium, zinc, tin, selenium, indium, and alloys thereof, tellurium and tellurium containing compositions.

* * * * *